US005259621A

United States Patent [19]

Keefer

[11] Patent Number: 5,259,621

[45] Date of Patent: Nov. 9, 1993

[54] CHIPPING AND PUTTING TRAINER DEVICE

[76] Inventor: Donald L. Keefer, 8626 Lawrence Hill Rd., Perry Hall, Md. 21228

[21] Appl. No.: 959,087

[22] Filed: Oct. 9, 1992

[51] Int. Cl.[5] ..... A63B 69/36

[52] U.S. Cl. ..... 273/187.2; 273/165; 273/189 R; 273/192; 273/187.5; 273/194 R

[58] Field of Search ..... 273/187.2, 189 R, 189 A, 273/187.4, 187.5, 165, 192, 191 R, 194 R

[56] References Cited

U.S. PATENT DOCUMENTS

| | | | |
|---|---|---|---|
| 1,279,924 | 9/1918 | Smith | 273/189 |
| 1,418.637 | 6/1922 | Flood | 273/189 |
| 1,530,519 | 2/1923 | Remington | 434/252 |
| 1,655,092 | 1/1928 | Davis | 273/189 |
| 1,962,256 | 6/1934 | Nelson et al. | 273/189 |
| 2,022,910 | 12/1935 | Hanley | 273/189 |
| 2,093,153 | 9/1937 | McCarthy | 273/189 |
| 2,450,162 | 9/1948 | Promen | 273/189 |
| 2,773,691 | 12/1956 | Redfield | 273/189 |
| 2,809,043 | 10/1957 | Brouwer | 273/189 |
| 2,980,426 | 4/1961 | Johnson | 273/189 X |
| 3,109,244 | 11/1963 | Trifaro et al. | 434/252 |
| 3,188,090 | 6/1965 | Job | 273/189 |
| 3,415,523 | 12/1968 | Boldt | 273/186 |
| 3,415,524 | 12/1968 | Vickers | 273/189 |
| 3,419,277 | 12/1968 | Martin | 273/189 |
| 3,429,571 | 2/1969 | Abel, Jr. | 273/26 |
| 3,595,583 | 7/1971 | Oppenheimer | 273/191 R |
| 3,672,682 | 6/1972 | Yanagidaira | 273/189 R |
| 3,680,869 | 8/1972 | Brady | 273/183 B |
| 3,698,389 | 10/1972 | Guedel | 273/189 A X |
| 3,820,794 | 6/1974 | Inoue | 273/183 B |
| 4,017,086 | 4/1977 | Washburn | 273/183 B |
| 4,134,589 | 1/1979 | Arena | 273/183 B |
| 4,239,228 | 12/1980 | Norman et al. | 273/189 R |
| 4,273,336 | 6/1981 | Larkey | 273/189 R |
| 4,318,546 | 3/1982 | Chen | 273/188 R |
| 4,575,089 | 3/1986 | Corbett et al. | 273/183 B |
| 4,582,325 | 4/1986 | Yuhara | 273/186 A |
| 4,593,909 | 6/1986 | Anselmo et al. | 273/188 R |
| 4,890,841 | 1/1990 | Brooks | 273/188 R |
| 4,919,433 | 4/1990 | Millar | 273/192 |
| 4,944,516 | 7/1990 | Bickler | 273/183 B |
| 4,948,142 | 8/1990 | Taber | 273/183 B |
| 4,998,731 | 3/1991 | Bowen | 273/183 B |
| 5,005,836 | 4/1991 | Nelson | 273/191 R |
| 5,024,443 | 6/1991 | Bellagamba | 273/188 R |
| 5,039,105 | 8/1991 | Ro | 273/183 B |
| 5,040,798 | 8/1991 | Leitao | 273/183 B |
| 5,050,885 | 9/1991 | Ballard et al. | 273/183 B |
| 5,085,437 | 2/1992 | Leitao | 273/183 B |
| 5,096,199 | 3/1992 | Wyatt et al. | 273/189 R |
| 5,145,179 | 9/1992 | Breed | 273/189 R |
| 5,203,568 | 4/1993 | Vasquez | 273/189 R X |

*Primary Examiner*—George J. Marlo
*Attorney, Agent, or Firm*—Leonard Bloom

[57] ABSTRACT

A chipping and putting training device. The device has a pair of cuffs which are joined to one another by a main body. The cuffs position the golfer's forearms and hold the arms and shoulders in place so that the golfer develops a muscle memory of the correct swing. The device is three-way adjustable to allow vertical, horizontal, and angular positioning of the cuffs and arms relative to one another.

14 Claims, 12 Drawing Sheets

CHIPPING AND PUTTING TRAINER DEVICE

FIELD OF THE INVENTION

The present invention relates to training devices for the practice of golf skills and, in particular, to a golf teaching and training aid for instilling proper chipping and putting techniques.

BACKGROUND OF THE INVENTION

The golf short game requires a firm and consistent stroke for both chips and putts. It is essential to maintain the proper alignment throughout the stroke. It is equally important to contain the wrists. Otherwise, there is a strong tendency for the right arm to overpower the left causing a break-down of the left wrist (assuming a right-handed golfer). Various prior art training devices have tried in various ways to teach the proper form for putting and/or chipping so as to improve one's overall game.

Many prior art training devices attempt to instill the proper alignment of the forearms relative to the intended target throughout the stroke. Other devices align the elbows or shoulders. Still others contain the wrists to prevent opening or closing of the club head. In all cases, it universally desirable to create a "muscle memory" from continued use of the training device. This way, the golfer will continue to utilize the device-taught stroke even without the aid of the device.

Examples of existing putting and/or chipping training devices include that disclosed in U.S. Pat. No. 4,896,887 issued to Cable. The Cable '887 training device has a pair of arm restraints, each of which is located on opposite sides of a yoke. The arm restraints and the yoke are formed to maintain the forearm and elbow of one arm above the forearm and elbow of the other arm. Unfortunately, this arrangement fails to achieve the proper alignment of the forearms, elbows, and shoulders to the intended target without any unnecessary muscle force.

U.S. Pat. No. 4,944,516 issued to Bickler discloses a putting trainer which is especially adapted to maintain the proper alignment of the right arm with a putter. Unfortunately, that device is not readily adaptable for use in chipping shots, and it provides no restraint for the left wrist.

U.S. Pat. No. 5,040,789 issued to Leitao discloses a chipping and putting trainer which includes a shaft and opposing loops which allow the shaft to be attached between the golfer's arms at the elbows. Like Bickler '516, the Leitao '789 device does not provide any wrist restraint.

None of the above-described prior art devices are capable of maintaining a full and proper alignment of the forearms, wrists and elbows relative to the intended target while still containing the wrists throughout the stroke. Hence, none of the above-described devices are capable of instilling a comprehensive "muscle memory" in the golfer.

The above-described and other known training devices also suffer from drawbacks relating to adjustment for golfers of different dimensions. For example, Leitao '789 provides only limited lateral adjustment of the spacing between the arm loops, and fails to provide any height or angular adjustment whatsoever.

Accordingly, it can be seen that there remains a need for a golf chip and putt training device which instills a complete "muscle memory" of all essential components of the stroke, and which provides for angular height adjustment and lateral adjustment to suit any golfer.

SUMMARY OF THE INVENTION

It is, therefore, an object of the present invention to provide a chipping and putting training device which instills a proper and comprehensive muscle memory of all mechanical components of the short game stroke (both chipping or putting). This includes proper alignment of the forearms, wrists and elbows relative to the intended target and throughout the entire stroke. This also includes containment of the dominant arm to prevent breakdown of the subordinate wrist.

It is another object of the present invention to provide a training device as described above which is capable of angular adjustment, lateral adjustment and height adjustment to accommodate golfers of virtually any dimension.

It is still another object of the present invention to provide a training device which is simple to install and easy to use.

It is another object of the invention to provide a training device as described above which is especially designed for low cost mass production.

In accordance with the teachings of the present invention, a chipping and putting training device is disclosed that includes a pair of cuffs for receiving therein respective forearms of a golfer. Straps are provided at each cuff for removably retaining the golfer's forearms. The cuffs of the training device may be adjusted laterally, angularly, and vertically relative to one another. The three-way adjustment is accomplished by an end section and a central section. The end section is mounted to one cuff. The central section includes a first portion that is slidably secured to the other cuff and a second portion that is coupled to the end section via an extension bar which protrudes from the end section.

The adjustability of the height (vertical positioning) of the cuffs is achieved by sliding the one cuff along the first portion of the central section and locking in a selected position.

The angular adjustability is provided by the first and second portions being pivotally joined to one another for selective adjustment of the angle of the first portion and the second portion relative to one another.

Lateral (horizontal) adjustability is provided by the end section being slidably joined to the second portion of the central section via the extension bar. The extension bar may be slidably inserted into the second portion of the central section and locked in position to maintain a selected horizontal spacing of the cuffs relative to one another.

With the above-described design, the device of the present invention provides for the angular, lateral (horizontal), and height (vertical) positioning of the troughs relative to one another to be selectively adjusted to suit the precise needs of each particular user.

An optional putter attachment stem is also disclosed for coupling either of the cuffs to a conventional putter for added stability.

In accordance with the teachings of the present invention, the chipping and putting trainer device disclosed herein provides for "muscle memory" of the proper triangular alignment of the shoulders, elbows and forearms, and of the pendulum-like motion which is necessary to perfect the short game (both chipping and putting).

These and further objects and advantages of the present invention will become readily apparent from a reading of the following description when taken in conjunction with the enclosed drawings.

BRIEF DESCRIPTION OF THE DRAWINGS

FIG. 8 illustrates the locking bolt 22 being unscrewed to release cuff 11*b* for vertical adjustment.

FIG. 9 illustrates the released cuff 11*b* being vertically adjusted as the T-bar 20 slides within the T-groove 21 of the respective end section.

FIG. 10 illustrates the locking bolt 22 being rotated into a second position wherein cuff 11*b* is locked.

FIG. 13 illustrates a locking screw being moved (rotated) into a second outward unlocking position wherein the locking screw is spaced from and releasing an extension bar.

FIG. 14 illustrates the released end section being laterally (horizontally) slid along at least a portion of the length of the extension bar in the extension bore formed in the central section.

FIG. 15 illustrates the locking screw being moved (rotated) into a first inward locking position wherein the locking screw abuts and maintains the extension bar in place thereby locking and maintaining the end section and the central section, and hence the troughs, in the selected lateral (horizontal) positions relative to one another.

FIG. 16 illustrates a locking bolt being rotated into a second unlocking position so that the first and second portions of the central section may be moved relative to one another.

FIG. 17 illustrates the two (first and second) portions of the central section of the device being angularly pivoted about a pivot rod.

FIG. 18 illustrates the locking bolt being rotated into a first locking position so that the first and second portions of the central section, and hence the troughs, are locked and maintained in the selected angle relative to one another.

DETAILED DESCRIPTION OF THE PREFERRED EMBODIMENTS

Figure 1A:
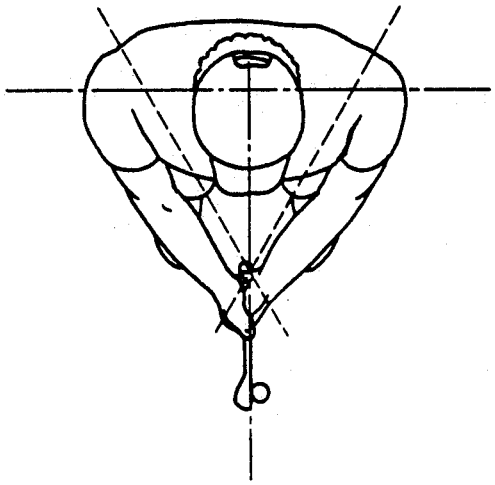
FIGS. 1A and 1B illustrate the common impulse of golfers to roll the hands over thereby causing misalignment of the golfer's hands during the swing which results in the golfer mis-hitting the ball so that the ball does not proceed towards its intended target.
Figure 1B:
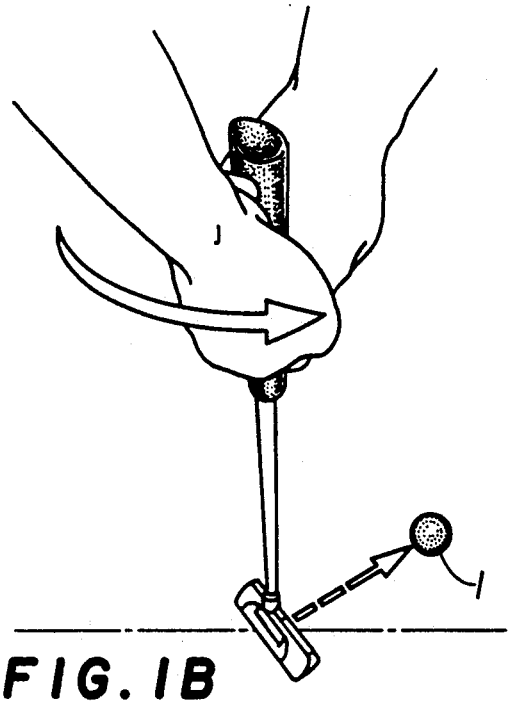

Essentially the same abbreviated golf swing is employed for all short game strokes (both chipping and putting). The proper alignment of the forearms, wrists and elbows relative to the intended target is illustrated in FIG. 1A (such alignment often being referred to as a proper "triangle"). The proper triangle must be maintained throughout the entire stroke. In addition, the dominant arm must be contained to prevent breakdown of the subordinate wrist. Unfortunately, it is natural for a golfer to impulsively turn his/her wrists. As shown in FIG. 1B, the trailing hand then rolls over the leading hand as the leading wrist breaks down. Such rolling of the hands disturbs the proper alignment and closes the club face, thereby causing the golfer to mis-strike the ball 1.

Figure 2A:
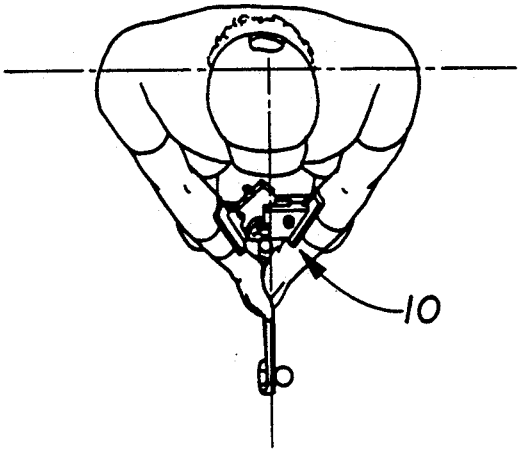
FIGS. 2A and 2B illustrate a golfer utilizing the device of the present invention to prevent rolling of the golfer's hands during the swing to insure proper alignment of the golfer's hand during the swing so that the ball proceeds towards its intended target.
Figure 2B:
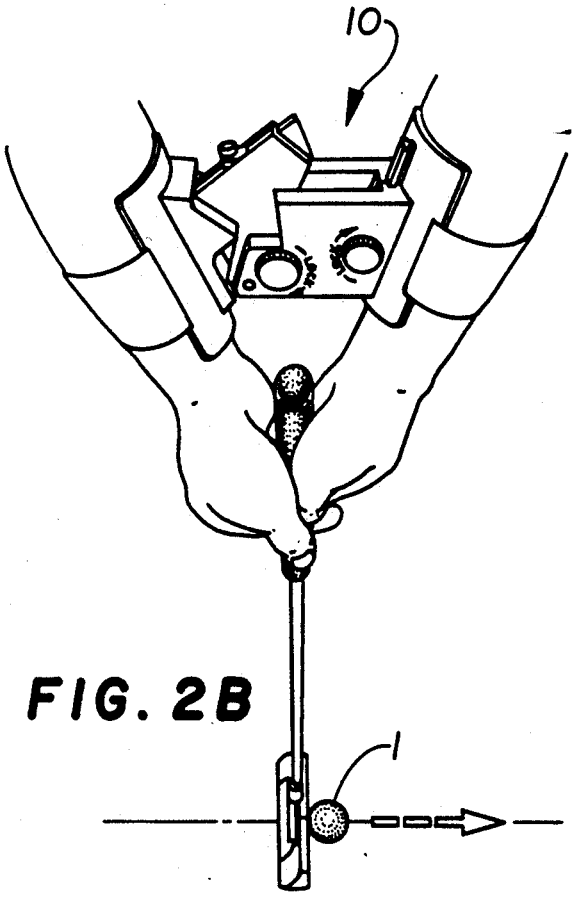
Figure 3:
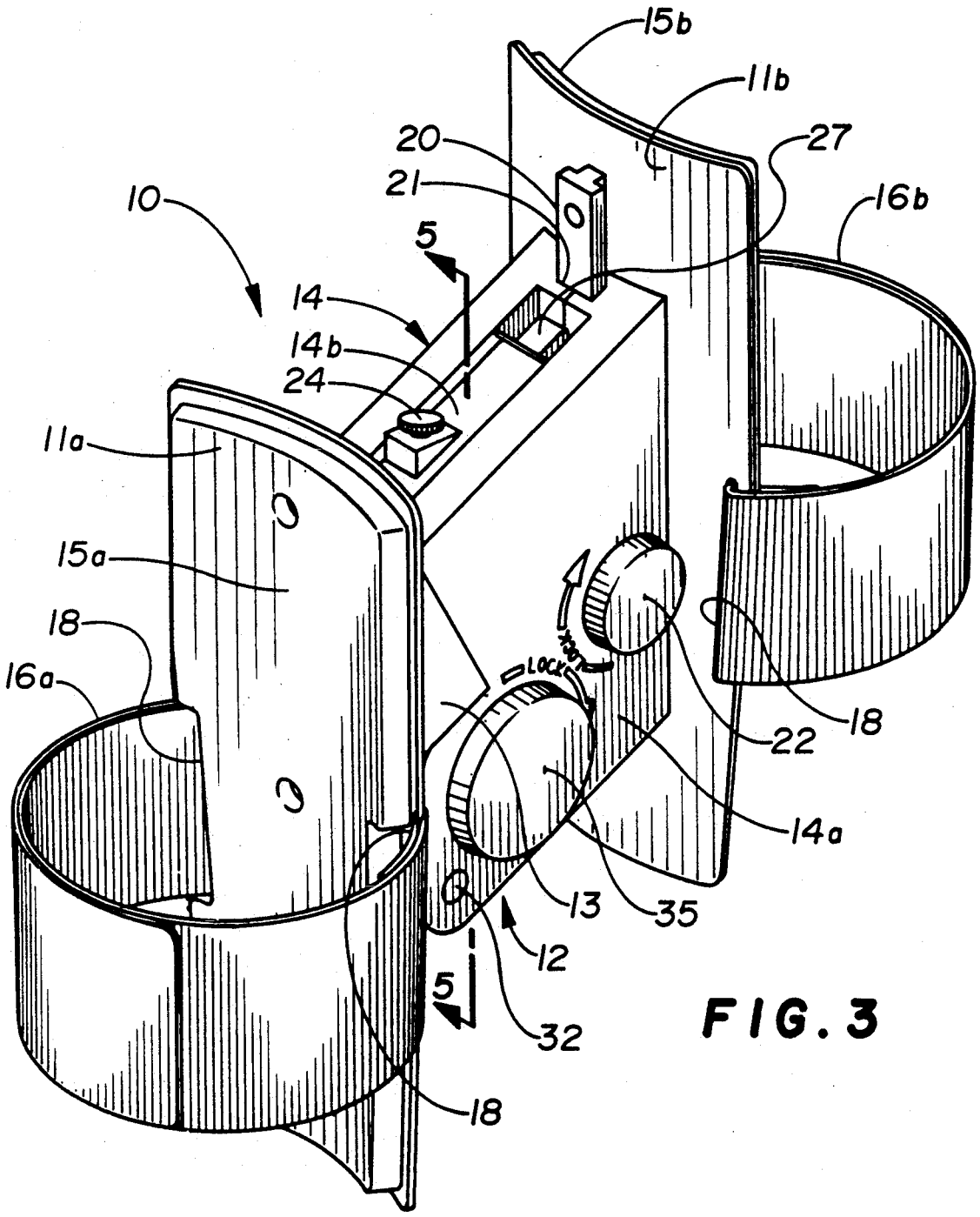
FIG. 3 is a perspective view of the chipping and putting trainer device of the present invention.
Figure 4:
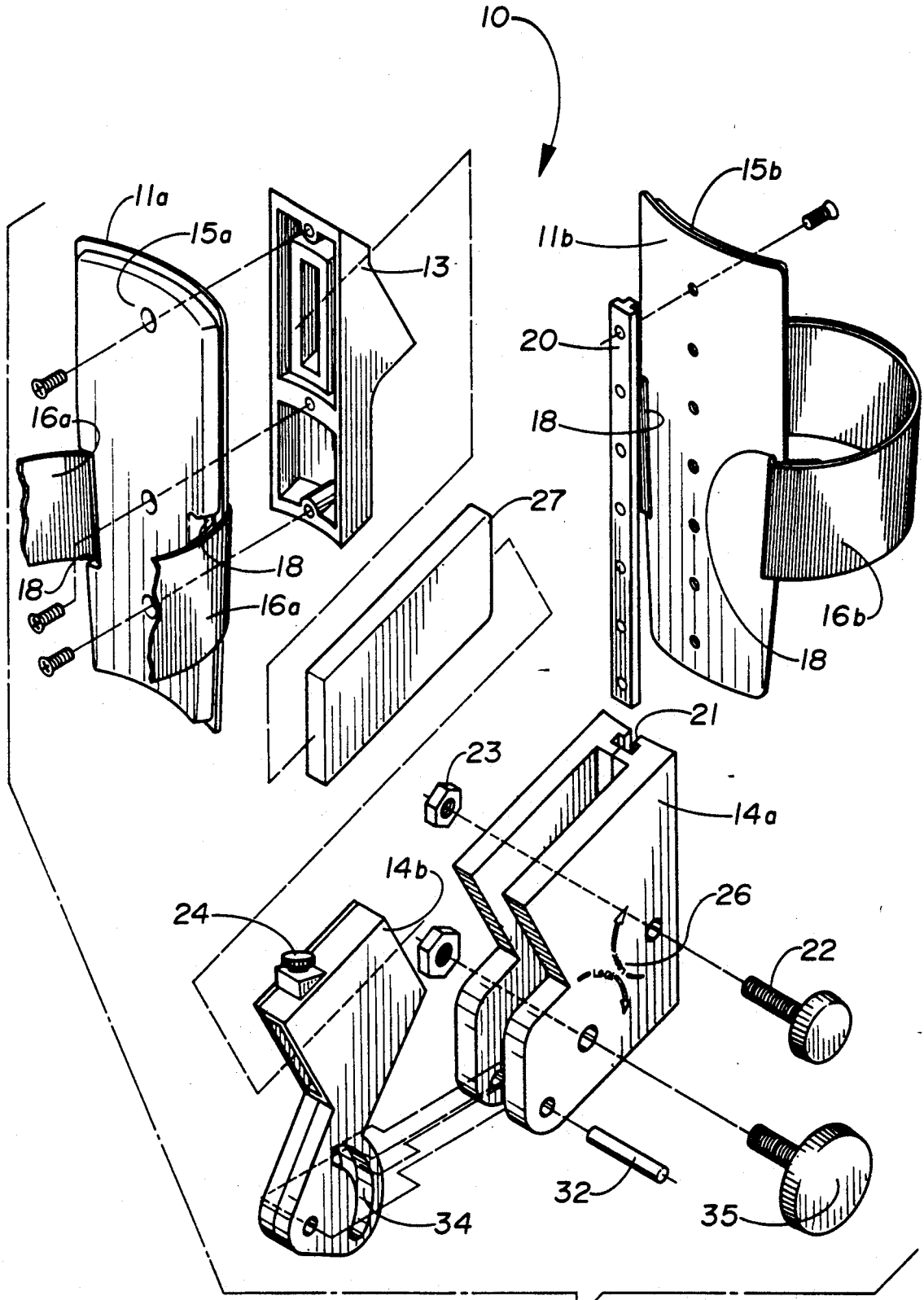
FIG. 4 is an exploded view of the chipping and putting trainer device of the present invention.
Figure 5:
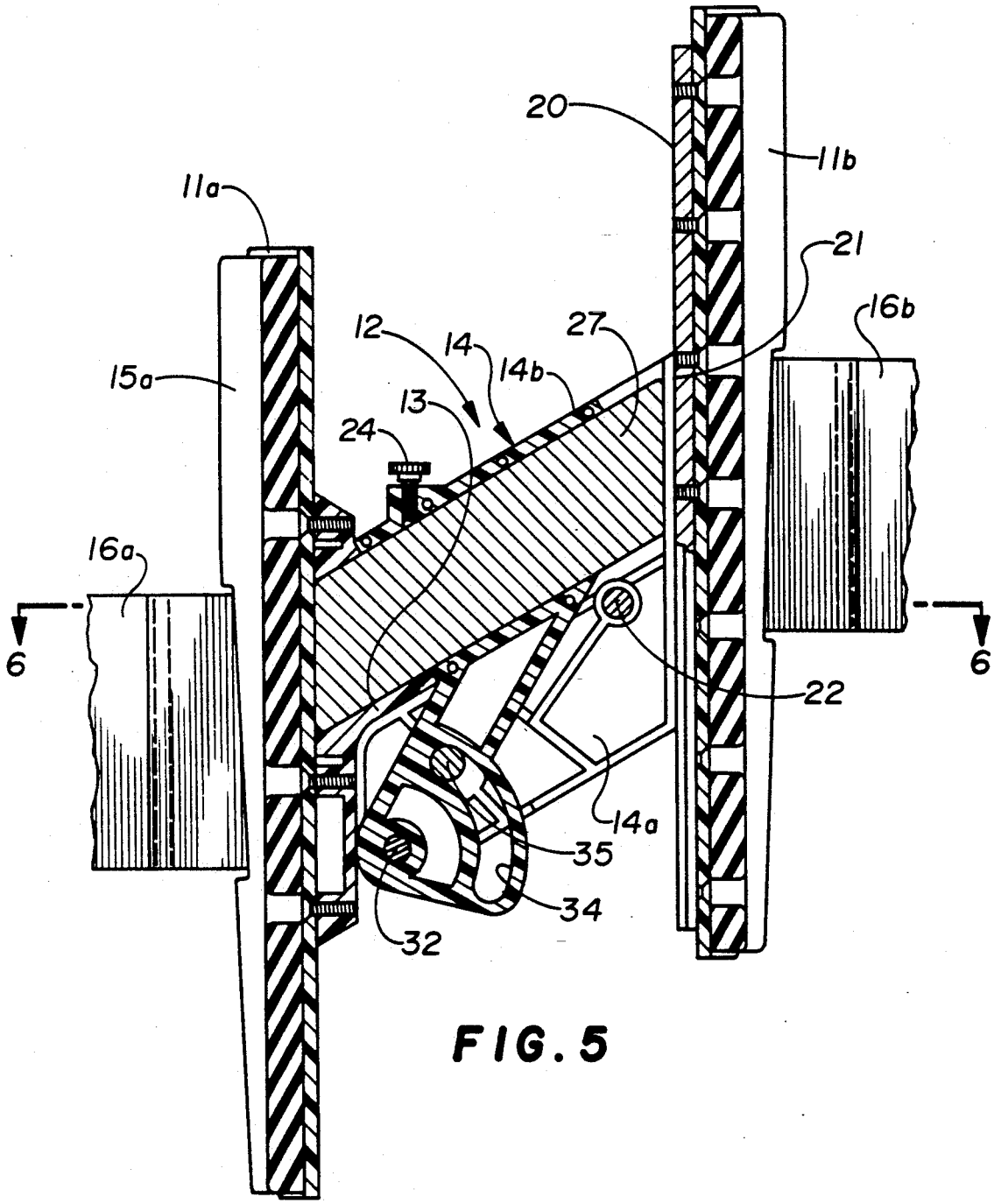
FIG. 5 is a front vertical cross-section view taken along line 5—5 of the chipping and putting trainer device of FIG. 3.

As shown in FIG. 2, the training device 10 of the present invention teaches the proper triangle and prevents rolling at the hands by securing and maintaining the golfer's forearms, elbows and shoulders in a fixed position throughout the entire swing. Moreover, both wrists are fully restrained and are prevented from breaking down. Hence, rolling of the hands is impossible and, as shown in FIG. 2B, the ball 1 will automatically be struck along the desired target line.

Repeated use of the training device 10 will enable the golfer to build up a muscle memory so that he/she will always automatically employ the proper mechanics as taught by the training device 10.

Referring now to FIGS. 3–6, the training device 10 is comprised of a pair of opposing cuffs 11 (11*a* and 11*b*) and a main body 12 to which the cuffs 11 are joined in a manner that shall be discussed at length below. The main body 12 includes an end section 13 and a central section 14. The central section 14 includes a first portion 14*a* which is pivotally joined to a second portion 14*b*.

The cuffs 11 are sculptured with an appropriate curve so as to comfortably receive therein respective forearms of the golfer. These cuffs 11 are, preferably, formed from molded plastic. The cuffs may, alternatively, be formed from metal or any other similar material that provides the device with sufficient rigidity. The interior surface of each cuff 11 is lined with padding 15 (i.e, 15*a* and 15*b* on respective cuffs 11*a* and 11*b*) such as, for instance, foam rubber. Padding 15 is secured therein to pad and protect the golfer's forearms during use.

Figure 7:
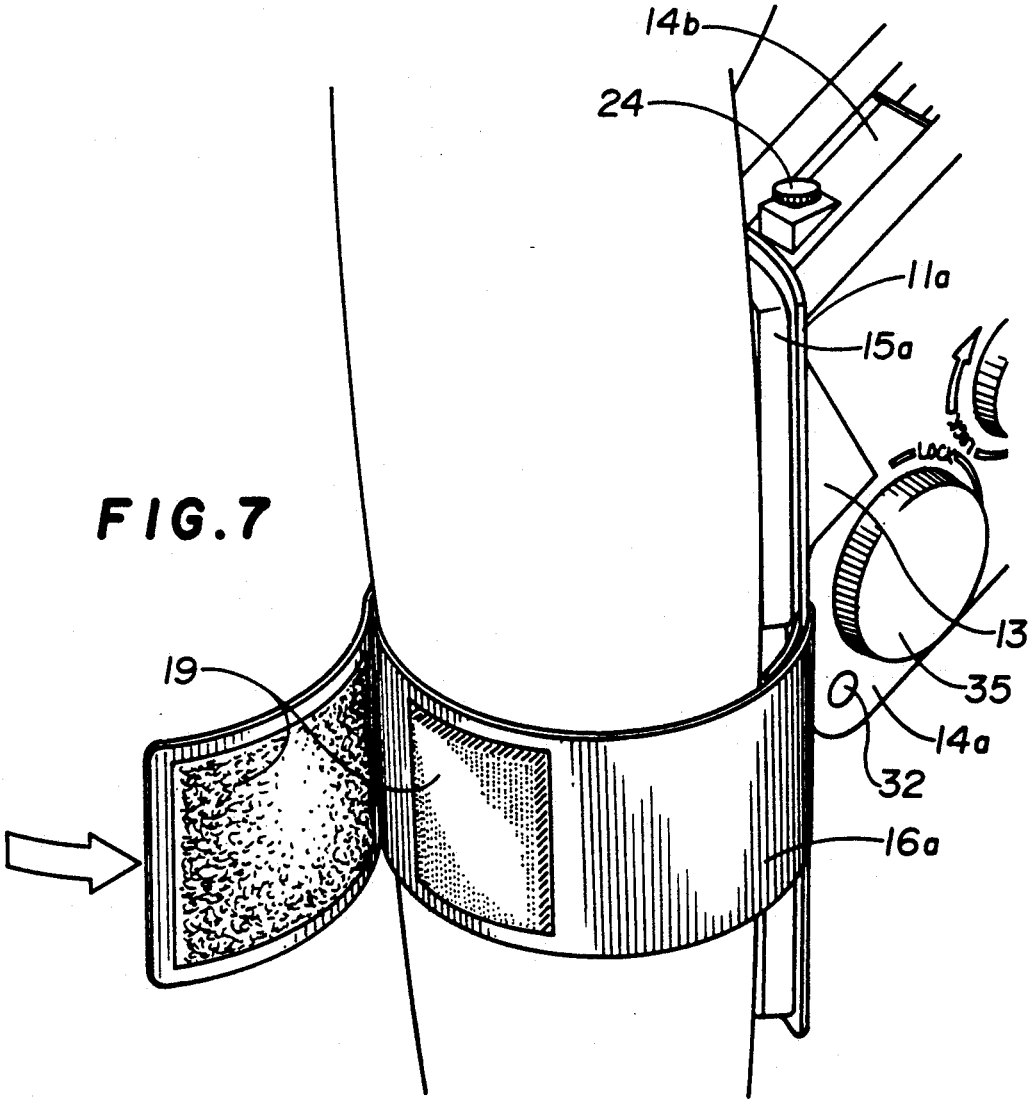
FIG. 7 illustrates the manner of attaching the cuffs 11 to the forearms.

With additional reference now to FIG. 7, restraining straps 16 (16*a* and 16*b*) are carried by each of the cuffs 11 for removably retaining the golfer's forearms in the respective cuffs 11. It is contemplated herein that such restraining straps 16 will be comprised flexible, elastic material.

Each of the straps 16a, 16b is secured at both ends to a respective cuff 11a, 11b so as to wrap around the forearm of the golfer. The securing may be achieved by looping each end of straps 16 in a corresponding pair of slots 18 formed in opposing sides of each cuff 11. Straps 16 are received through the slots 18 and are looped back on themselves for increased strength. Preferably, each strap 16 is provided with a respective hook-and-loop fastener 19 carried thereon for convenient application and removal of straps 16 to/from the respective forearms of the golfer. However, buckles, hooks, or any other suitable securing means well-known to those skilled in the art may be employed for this purpose.

Figure 8:
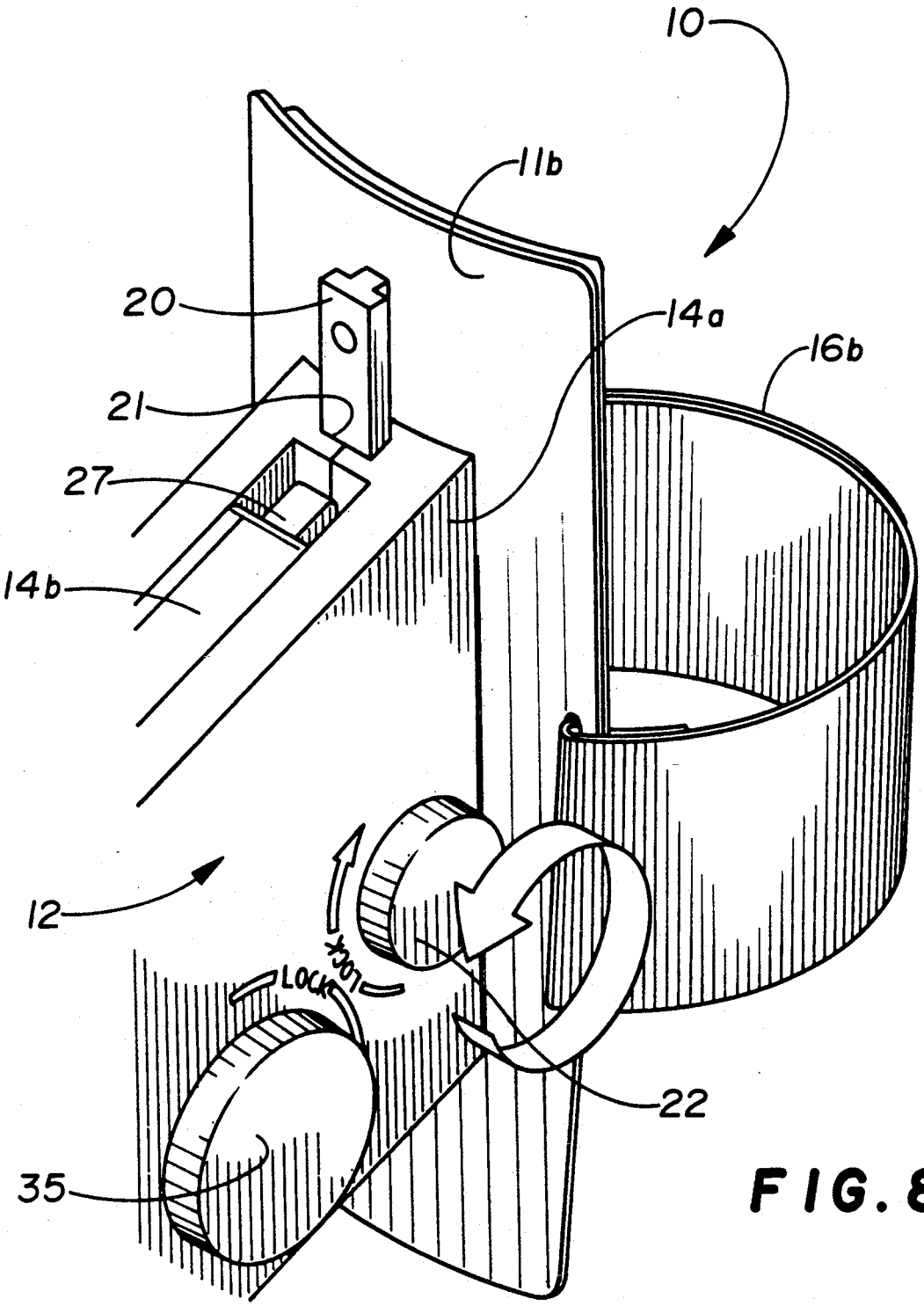
FIGS. 8–10 sequentially illustrate the unlocking, adjustment, and locking of cuff 11*b* during vertical positioning.
Figure 9:
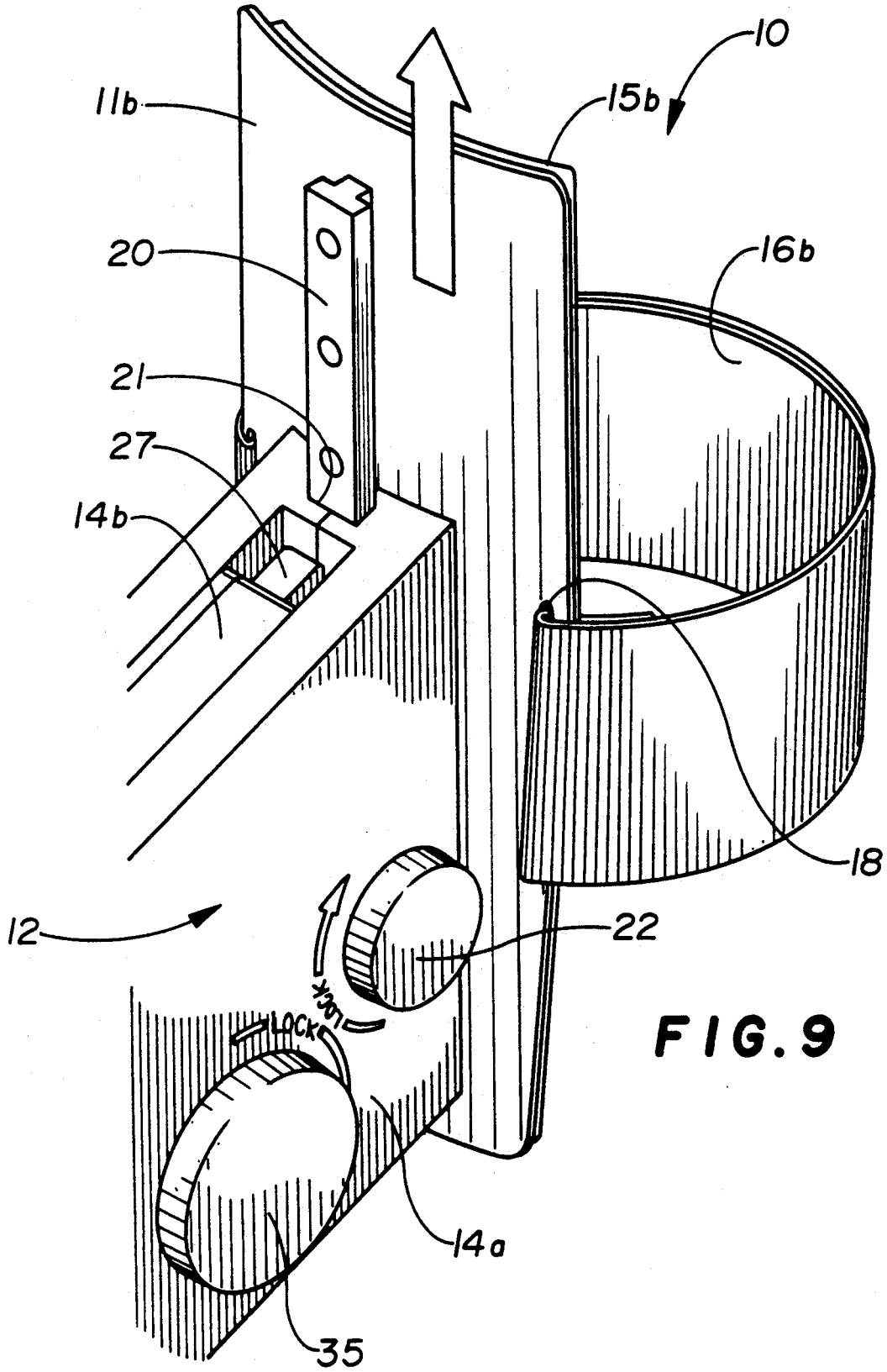
Figure 10:
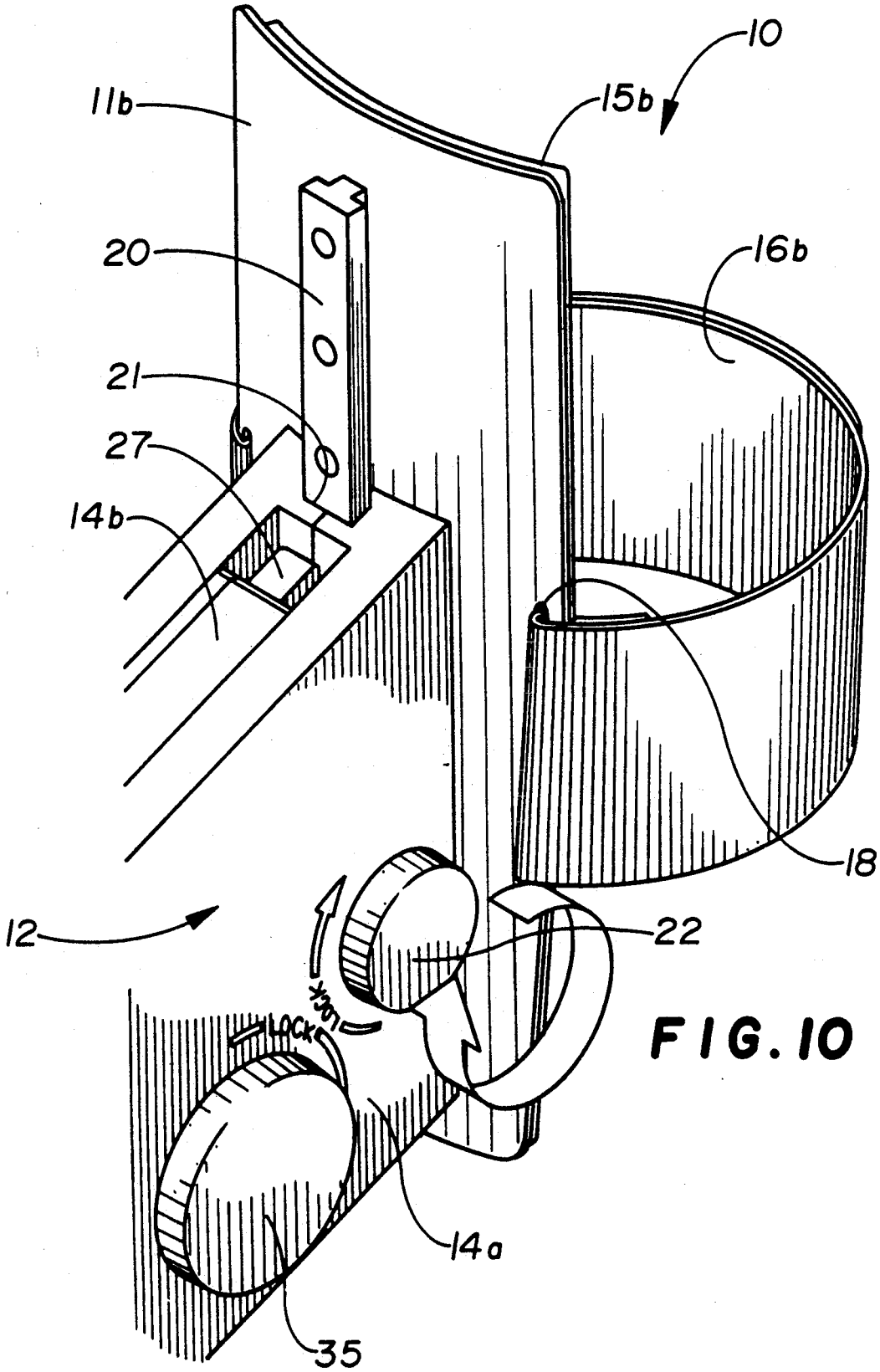

With additional reference now to FIGS. 8–10, one of the cuffs 11a is integrally secured to the end section 13 while the other of the cuffs 11b is slidably carried by the first portion 14a of the central section. This allows for convenient vertical positioning of cuffs 11b relative to cuff 11a and the central section 14 to accommodate golfers of different dimensions.

Figure 6:
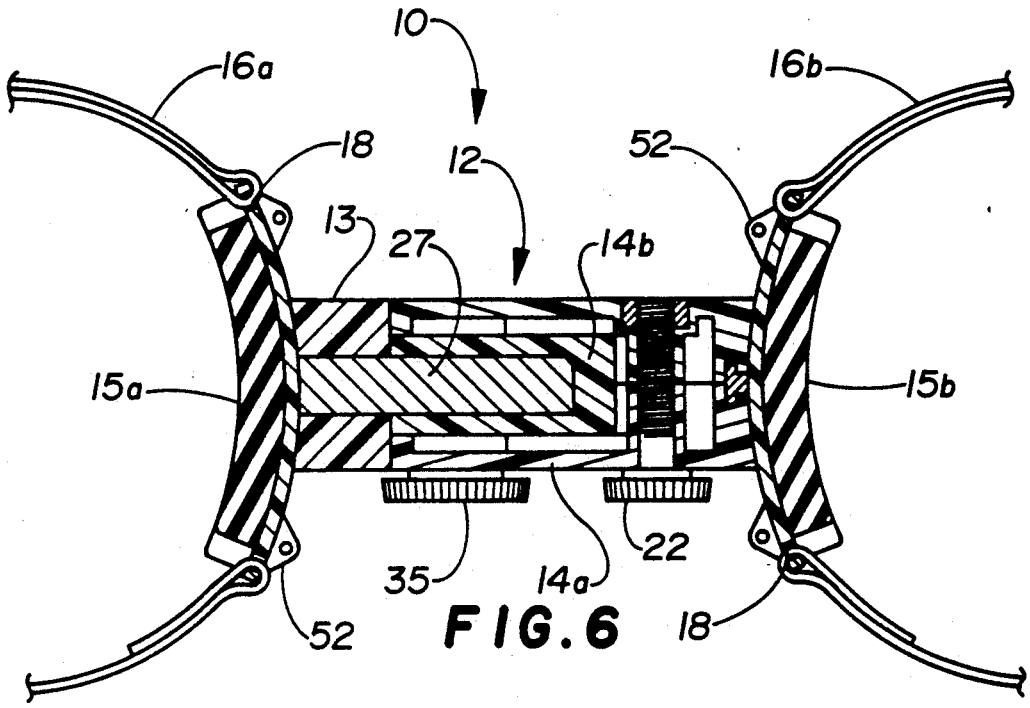
FIG. 6 is an overhead horizontal cross-section view taken along line 6—6 of the chipping and putting trainer device of FIG. 5.

To permit the sliding vertical adjustment of cuff 11b relative to the central section 14, said cuff 11b is provided with a protruding T-bar 20 integral to cuff 11b and extending along the length (shown in cross-section in FIG. 6). Likewise, the first portion 14a of the central section 14 is provided with a T-groove 21 recessed inwardly opposite the T-bar 20. The T-bar 20 and the T-groove 21 are appropriately sized to allow the T-bar 20 to be slidably received within the T-groove 21. Hence, cuff 11b is slidably adjustable relative to cuff 11a and central section 14 to precisely fit the measurements of a particular golfer. The central section 14 (with T-groove 21) and the cuff 11b (with T-bar 20) may be constructed from discrete metal parts secured by screws or the like (as shown in FIGS. 3–10, or they may be integrally formed from molded plastic.

The first portion 14a of the central section 14 extends outwardly from T-groove 21 toward the first cuff 11a, and the extending end is formed with a central hollow flanked by opposing sides.

A tightening screw 22 penetrates the first portion 14a of the central section 14 near the T-groove 21 and is held captive therein by a threaded nut 23. Screw 22 may be tightened/loosened to compress/release the sides of first portion 14a. As screw 22 is tightened, the sides of first portion 14a are drawn together. This in turn compresses the T-bar 20 of cuff 11b within the notch 21 of first portion 14a to thereby to removably secure cuff 11a in the desired vertical position relative to the central section 14. As shown in FIG. 6, the nut 23 may be recessed within first portion 14a.

To facilitate the rotational movement of screw 22, a knob is provided at the protruding end. The knob is preferably sizable and defined by a peripheral gripping surface to facilitate hand-tightening by the golfer. To further facilitate the operation of the training device 10 in this respect, the first portion 14a of the central section 14 may bear indicia 26 proximate screw 22 to indicate the direction in which the knob needs to be turned to lock or release the cuff 11b.

Figure 11:
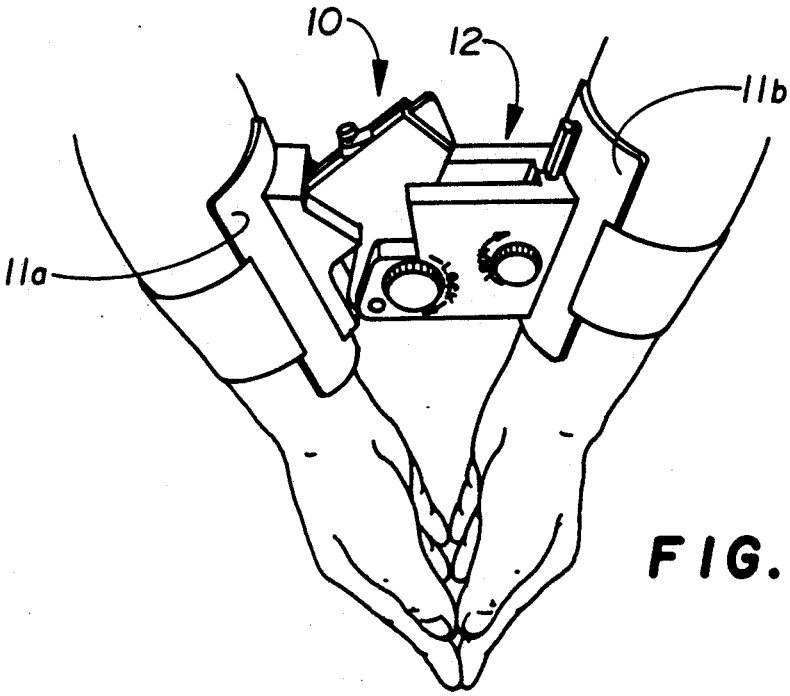
FIG. 11 illustrates the proper triangular alignment that builds "muscle memory."
Figure 12:
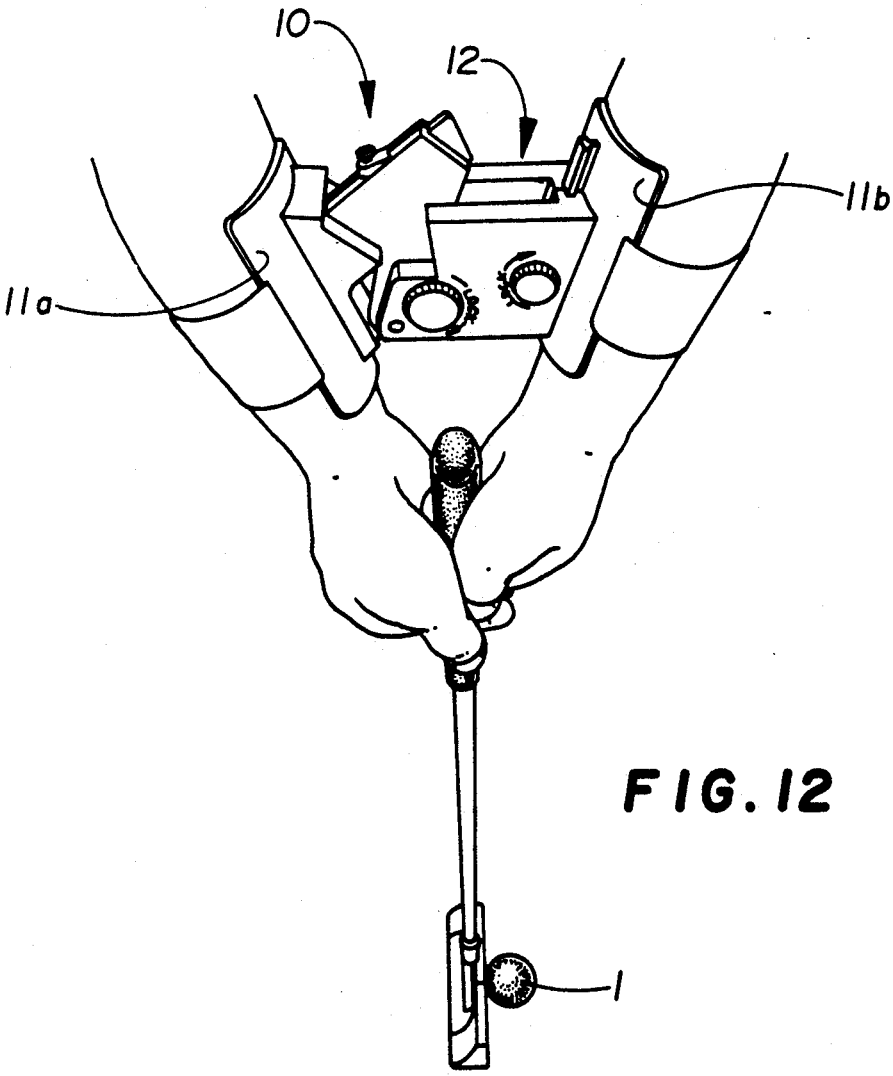
FIG. 12 illustrates a perspective view as in FIG. 11 with a correct putting grip.

With reference now to FIGS. 11 and 12, as was noted above, it is one objective of the training device 10 to build up in the golfer thereof a "muscle memory" of the proper stroke to utilize so that the golfer will automatically execute the proper stroke without having to think about it. However, it is a further object to allow the golfer as much freedom as possible, for instance, to choose another ball after each shot. In this regard, it is desirable for the cuffs 11a and 11b of the training device 10 to separate with little effort. This objective is achieved by removably joining the end section 13 to the second portion 14b of the central section 14 via an extension bar 27. One end of extension bar 27 is anchored within an outwardly facing slot formed in end section 13. The extension bar 27 may be anchored in end section 13 in any suitable manner, such as by being press-fitted therein. The other end of bar 27 is received in a slot 28 formed in the second portion 14b. The slot 28 formed in the second portion 14b is appropriately sized to removably, slidably receive the extension bar 27 therein.

Figure 13:
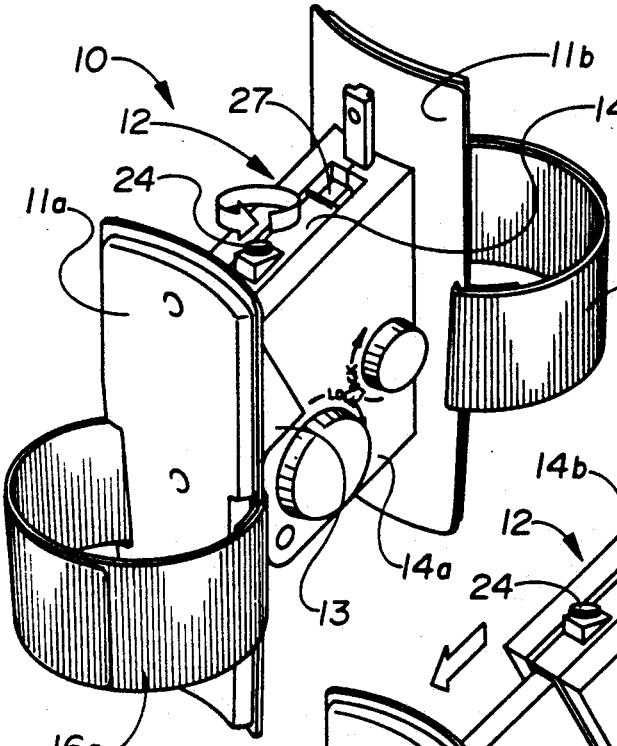
FIGS. 13–15 are perspective views, with portions thereof broken away for the sake of clarity, illustrating the lateral (horizontal) adjustment of the troughs of the present invention.
Figure 14:
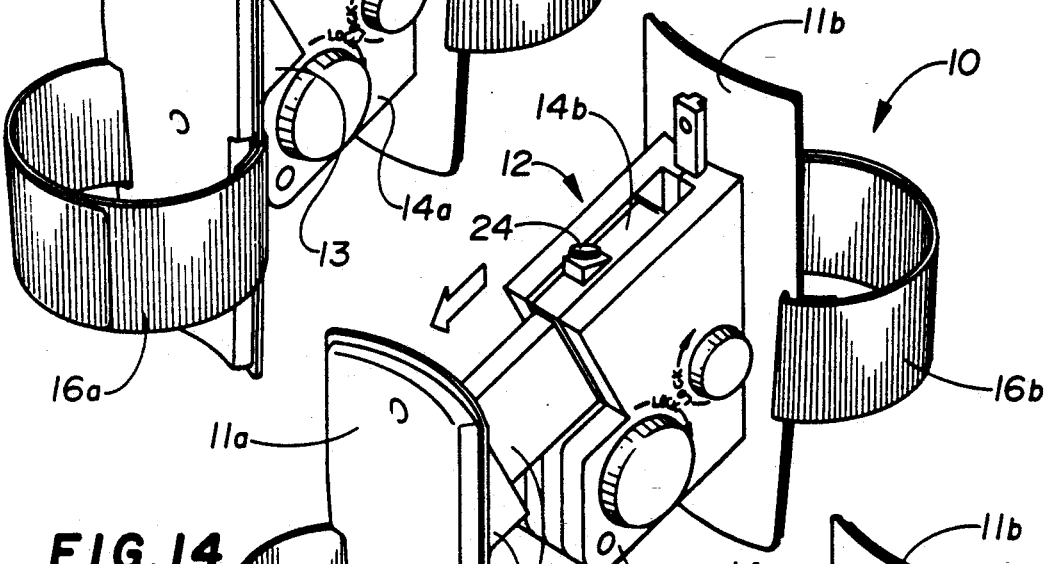
Figure 15:
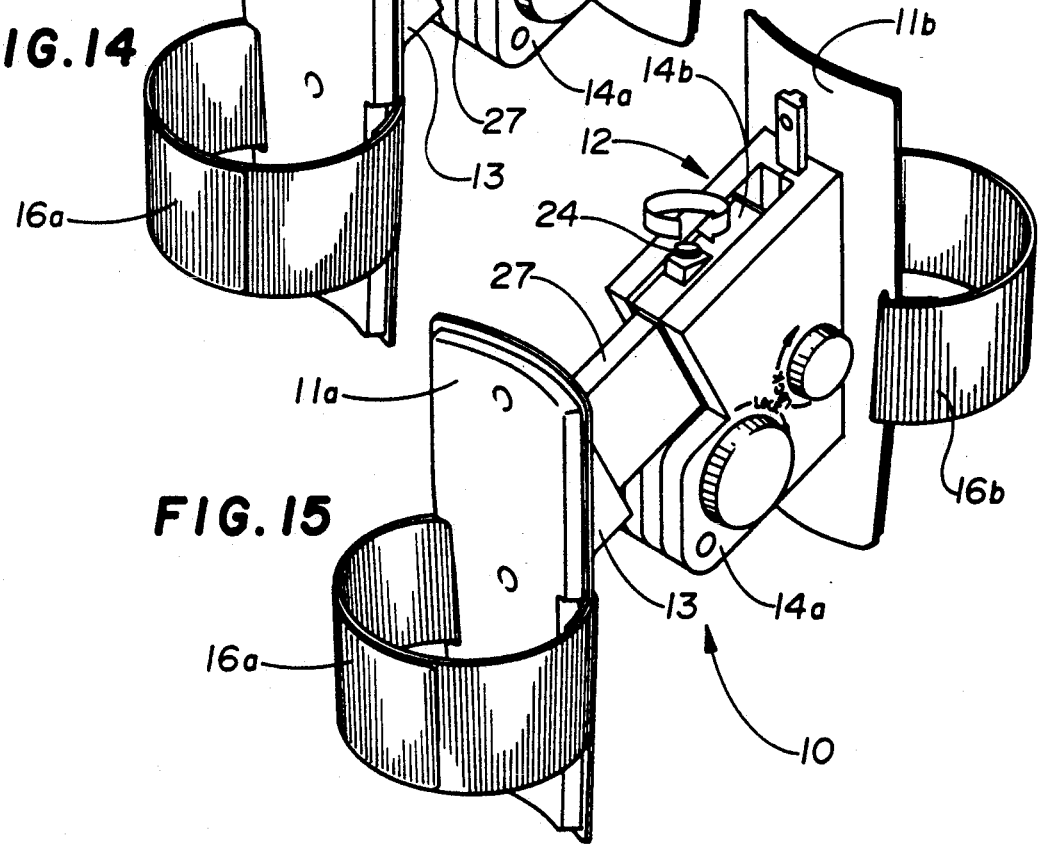

As shown in FIG. 13, a set screw 24 is provided to maintain a fixed spacing between cuff 11a (and end section 13) and cuff 11b (and second portion 14b of the central section 14). Set screw 24 is threaded into the second portion 14b of central section 14 and may be screwed therein until it bears against the interior extension bar 27. As shown in FIGS. 14 and 15, this serves to allow convenient lateral adjustment of the spacing between cuff 11a (and end section 13) and cuff 11b (and second portion 14b of the central section 14) to fit any golfer. In addition, end section 13 can be quickly detached from second portion 14b to free the golfer's hands between strokes. This way, the golfer can retrieve a new ball without unstrapping cuffs 11a and 11b.

Figures 16, 17, 18:
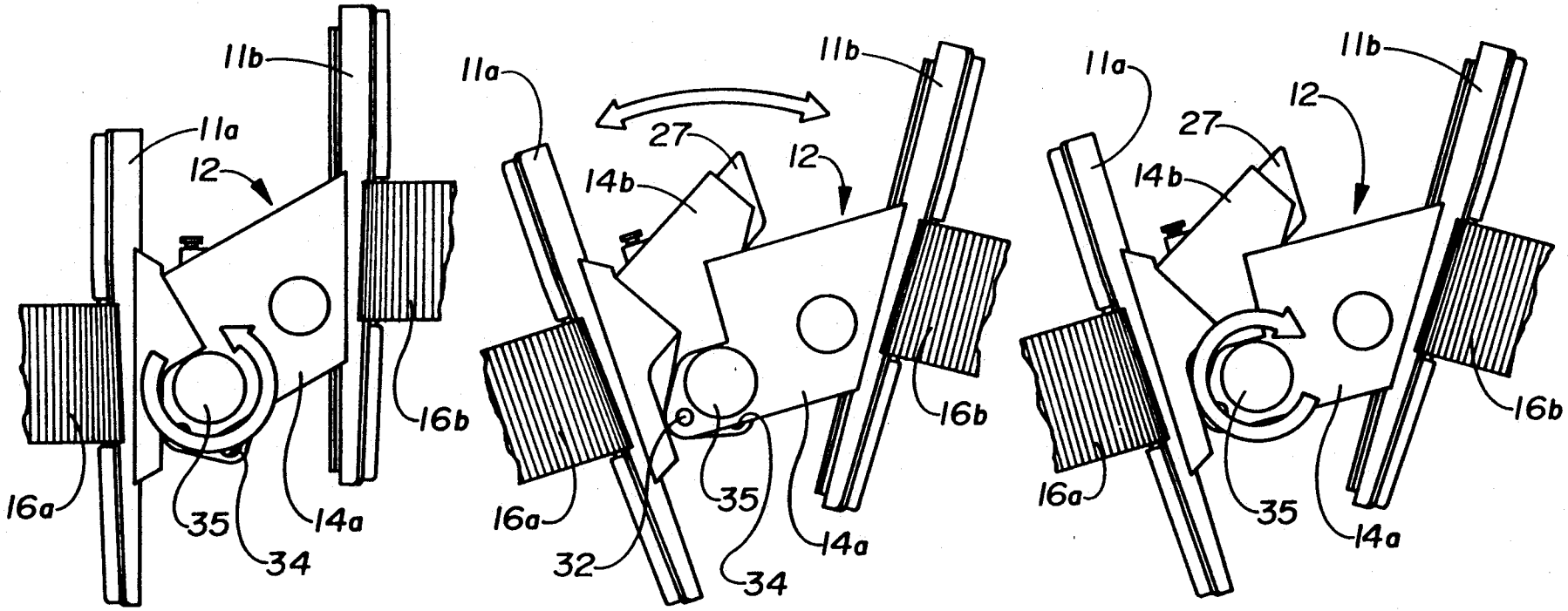
FIGS. 16–18 are perspective views, with portions thereof broken away for the sake of clarity, illustrating the preferred embodiment for effectuating the angular adjustment of the troughs of the device of the present invention.

With further reference to FIGS. 16–18, it is shown how the first and second portions 14a and 14b of the central section 14 are pivotally joined to one another to provide a third essential adjustment of the angle by which the golfers arms grip the club. As shown, the opposing sides of portion 14a flank portion 14b and are pivotally joined thereto by a pivot pin 32. Pivot pin 32 is anchored in both sides of the first portion 14a and passes through portion 14b. This pivotal coupling permits selective adjustment of the angle of the cuff 11a relative to cuff 11b.

In addition, a locking assembly 33 is provided for securing the first portion 14a and the second portion 14b of the central section 14 in the selected angular position relative to one another. In the preferred embodiment, the locking assembly 33 is comprised of an arcuate groove 34 formed in the second portion 14b inwardly of pivot pin 32. The opposing sides of first portion 14a at least partially cover groove 34, and a locking bolt 35 passes through groove 34 and is held captive in the opposing sides of first portion 14a. The locking bolt 35 and arcuate slot 36 are substantially aligned with one another such that bolt 35 may slide the length of groove 34 as the first portion 14a is pivoted relative to the second portion 14b. The locking bolt 35 is preferably provided with an accessible knob thereon for convenient rotation between a first locked position and a second unlocked position.

In the first locked position, the locking bolt 35 compresses the opposing sides of the first portion 14a against the centrally carried second portion 14b to secure the second portion 14b therebetween. Hence, tightening of locking bolt 35 immobilizes the first portion 14a relative to the second portion 14b and maintains a desired angular orientation of cuff 11a relative to cuff 11b. Bolt 35 may be unscrewed to a second unlocking position, wherein the first and second portions 14a and 14b are disengaged to permit the selective angular positioning of cuffs 11a and 11b relative to one another.

Although the foregoing description has presented the training device 10 in the context of a right-handed golfer, it should be appreciated that the device 10 may be worn backward to confer the same benefits on a left-handed golfer.

Figure 19:
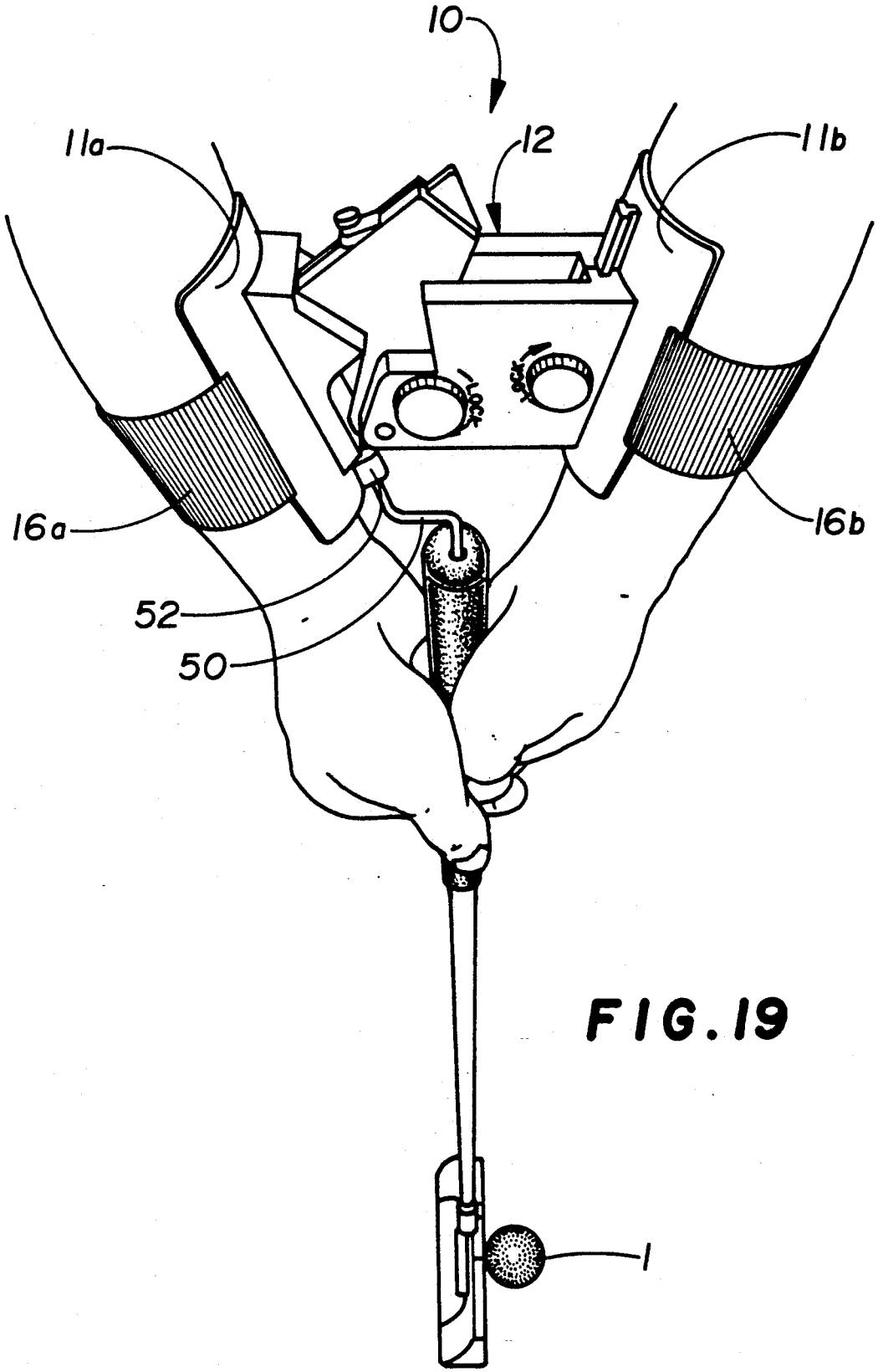
FIG. 19 illustrates an optional stein attachment 50 which may be connected to the training device 10 and inserted into the handle of a conventional putter for further stabilizing the putting stroke.

FIG. 19 shows an optional putter attachment which comprises an angled stem 50. Stem 50 is press-fit into a collar 52 which may be integrally formed on either of cuffs 11*a* or 11*b*. Stem 50 extends downwardly and is angled inward to the handle of the putter. Conventional putter grips are molded with a small hole at the tip, and the extending end of stem 50 may be inserted within said hole to provide a stabilizing coupling between the training device 10 and the putter. This further restraint adds an additional element to the muscle memory needed for the proper putting or chipping stroke. It is contemplated that a cache of stems 50, each of different lengths, may be mounted on the training device 10 to accommodate golfers of different dimensions.

It is also contemplated that cuff 11*b* can be detached and removed completely to practice a one handed putting stroke. For this, cuff 11*a* is strapped to the dominant arm and stem 50 is inserted into the putter. The golfer may then practice a one-handed putting stroke using the dominant arm. If the golfer's subordinate wrist is prone to breaking (rolling over), one-armed practice eliminates the subordinate arm completely and helps to develop a proper muscle memory.

Obviously, many modifications may be made without departing from the basic spirit of the present invention. Accordingly, within the scope of the appended claim, the invention may be practiced other than has been specifically disclosed herein.

What is claimed is:

1. A chipping and putting training device comprising:

a pair of cuffs including a first cuff and a second cuff for stabilizing respective forearms of a golfer;

a pair of straps each attached to one of said cuffs for removably securing the golfer's forearms within the respective cuffs;

an end section integrally attached to said first cuff;

an extension bar protruding from said end section; and a central section including a first portion slidably engaging said second cuff for a first adjustment of a vertical positioning of said second cuff relative to said central section and first cuff, and a second portion adapted for receiving said extension bar, said extension bar being slidably insertable in said second portion to permit a second adjustment of a lateral spacing between said first and second cuffs, said first and second portions being pivotally joined together to permit a third adjustment of a relative angle of the first cuff relative to the second cuff, whereby said first adjustment of vertical positioning, said second adjustment of lateral spacing, and said angular adjustment of the cuffs relative to one another may be independently accomplished to suit different golfers.

2. The chipping and putting training device of claim 1, further comprising a locking assembly for securing the first portion and the second portion of the central section in a selected angular position relative to one another.

3. The chipping and putting training device of claim 2, wherein said pair of straps each include a hook-and-loop fastener carried thereon for removably securing said straps around the respective forearms of the golfer.

4. The chipping and putting training device of claim 2, wherein the first and second cuffs each comprise a pair of slots formed in opposite sides of said cuff for securing the respective strap thereto.

5. The chipping and putting training device of claim 1, wherein the pair of straps for removably retaining the golfer's forearms in the respective cuffs each comprise elastic material.

6. The chipping and putting training device of claim 1, wherein said second cuff is provided with a T-bar extending lengthwise, and said first portion of said central section includes a T-groove conforming to said T-bar, said T-bar being slidably carried within said T-groove to permit said first adjustment of the vertical positioning of said second cuff relative to said central section and first cuff.

7. The chipping and putting training device of claim 6, wherein said first portion of said central section includes a locking screw for compressing said T-groove, thereby allowing selective locking of said T-bar therein to maintain said vertical positioning of said second cuff relative to said central section and first cuff.

8. The chipping and putting training device of claim 6, wherein said extension bar is integrally attached to said end section and is insertable into said second portion of said central section.

9. The chipping and putting training device of claim 8, wherein said the second portion of said central section further comprises a set screw threaded therein for selective engagement of said extension bar, whereby a selected lateral spacing between said pair of cuffs may be maintained by said set screw.

10. The chipping and putting training of claim 1, whereby said first portion of said central section further comprises flanking sides for embracing said second portion, and said central section further comprises a pivot pin anchored in said first portion and holding said second portion captive therebetween for angular positioning of said first and second cuffs relative to one another.

11. The chipping and putting training device of claim 10, wherein said second portion extends beyond said pivot pin between said first portion, and said central section further includes a locking assembly engagable with the extended second portion for maintaining the selected angular position.

12. The chipping and putting training device of claim 11, wherein said locking assembly further comprises a locking bolt rotatably journaled and received through the first and second portions of the central section at an offset from said pivot pin.

13. The chipping and putting training device of claim 12, wherein said locking assembly further comprises an arcuate groove formed in said second portion, said locking bolt passing through said arcuate groove and slidable therein to permit limited pivoting of said first portion relative to said second portion.

14. The chipping and putting training device of claim 1, further comprising a putter attachment stem attached to one of said pair of cuffs and insertable into a putter for added stabilization.

* * * * *